US009358449B2

(12) United States Patent
Robustelli et al.

(10) Patent No.: US 9,358,449 B2
(45) Date of Patent: Jun. 7, 2016

(54) DEVICE FOR PLAYING FOOTBALL

(71) Applicant: LIMMAT PRODUKT GMBH, Zurich (CH)

(72) Inventors: Urs Robustelli, Zurich (CH); Gregor Altenburger, Zurich (CH)

(73) Assignee: LIMMAT PRODUKT GMBH, Zurich (CH)

( * ) Notice: Subject to any disclaimer, the term of this patent is extended or adjusted under 35 U.S.C. 154(b) by 0 days.

(21) Appl. No.: 14/363,889

(22) PCT Filed: Nov. 28, 2012

(86) PCT No.: PCT/CH2012/000264

§ 371 (c)(1),
(2) Date: Jun. 9, 2014

(87) PCT Pub. No.: WO2013/082728

PCT Pub. Date: Jun. 13, 2013

(65) Prior Publication Data

US 2014/0346730 A1 Nov. 27, 2014

(30) Foreign Application Priority Data

Dec. 9, 2011 (CH) ..... 1958/11

(51) Int. Cl.
*A63F 7/06* (2006.01)
*A63F 7/24* (2006.01)

(52) U.S. Cl.
CPC ..... *A63F 7/2472* (2013.01); *A63F 7/0616* (2013.01); *A63F 7/2481* (2013.01); *A63F 7/062* (2013.01)

(58) Field of Classification Search
CPC ..... A63F 7/06; A63F 7/0616; A63F 7/20; A63F 7/22; A63F 7/24; A63F 7/2409; A63F 7/2472; A63F 7/2481; A63F 7/062
USPC ..... 273/317, 317.1, 317.5, 108.1, 108.53, 273/108.55, 129 R, 129 S, 129 T, 129 W, 273/127 R, 127 B
See application file for complete search history.

(56) References Cited

U.S. PATENT DOCUMENTS 1,954,838 A * 4/1934 Woolsey et al. ..... 273/317.5
2,249,670 A * 7/1941 Sidle ..... 446/333

(Continued)

FOREIGN PATENT DOCUMENTS

CN 101367014 A 2/2009
FR 2724121 A1 3/1996

(Continued)

OTHER PUBLICATIONS

International Search Report for PCT/CH2012/000264, mailed Mar. 25, 2013; ISA/EP.

*Primary Examiner* — Raleigh W Chiu
(74) *Attorney, Agent, or Firm* — Harness, Dickey & Pierce, P.L.C.

(57) ABSTRACT

The invention relates to a device for playing football (1), comprising a ball (16), a base (7) on which at least one ball holder is provided, an accelerating element (2, 2'), and a drive arrangement for the accelerating element (2, 2'). The drive arrangement carries the accelerating element (2, 2') and is designed to drive the accelerating element from a starting position (SP) towards the ball holder, such that the accelerating element (2, 2') impacts on the ball (16) under propulsion. The accelerating element (2, 2') is fastened to the drive arrangement in a position-adjustable manner by means of a fastening arrangement, such that the impact position (AP) of the accelerating element (2, 2') on the ball (16) located on the ball holder is adjustable.

16 Claims, 2 Drawing Sheets

(56) References Cited

U.S. PATENT DOCUMENTS

| | | | | |
|---|---|---|---|---|
| 3,911,616 | A | 10/1975 | Pelfrey | |
| 6,280,285 | B1 * | 8/2001 | Morehouse | 446/333 |
| 6,659,457 | B1 * | 12/2003 | Cheng | 273/108.53 |
| 2007/0093174 | A1 * | 4/2007 | Cheung et al. | 446/336 |
| 2009/0039597 | A1 * | 2/2009 | Capusotto | 273/108.1 |
| 2009/0096170 | A1 * | 4/2009 | Pettis | 273/317.5 |

FOREIGN PATENT DOCUMENTS

| | | | |
|---|---|---|---|
| FR | 2890872 | A1 | 3/2007 |
| GB | 616582 | A | 1/1949 |
| JP | 2006204880 | A | 8/2006 |
| WO | WO-0037153 | A1 | 6/2000 |

* cited by examiner

DEVICE FOR PLAYING FOOTBALL

FIELD OF THE INVENTION

The invention relates to a device for playing football.

PRIOR ART

Play devices having acceleration apparatuses are known which accelerate a toy car on a launch ramp by means of pulling back and releasing of a rubber band slider. Here, during the release of the tensioned rubber band slider which stores acceleration energy, the toy car absorbs the acceleration energy of the rubber band slider and is driven forward and is discharged via a launch ramp at the end of the apparatus into a track. In the track, the toy car gradually discharges the absorbed acceleration energy again and finally comes to a standstill. U.S. Pat. No. 6,659,457 B1 has disclosed a device for playing football, in which a plate can be pivoted about a vertical pivot axis and the plate supports a football player, the leg of which can be rotated about a rotational axis and is connected to a ball striking element which can be driven by a spring, it being possible for a ball to be accelerated toward a goal by way of the ball striking element. JP2006-204880 A has disclosed a device for playing football, in which a leg of a game figure can be rotated about an axis and can be driven toward a ball by way of a spring. The position of the game figure on a plate can be changed, since the game figure is arranged rotatably on the plate by means of a pin. Depending on the rotational position of the game figure, the ball is placed into a different ball holder for the shot. CN 101367014 A likewise discloses a game figure having a leg which can be driven. A game figure of this type is also known from WO 00/37153 A1.

SUMMARY OF THE INVENTION

It is an object to provide a further device for playing football, in particular a play device which affords additional play options.

This object is achieved by way of the features of claim 1.

Improved play options result from the fact that the acceleration element is fastened to the drive arrangement in a positionally adjustable manner by means of a fastening arrangement, in such a way that the impact position of the acceleration element on the ball which is situated on a ball holder can be set.

Extended play options are provided by way of the adjustability of the acceleration element, it being possible to accelerate the ball in such a way that its trajectory can be directed more precisely in a predefinable direction which is desired by the player and/or the ball can be played with spin.

In one particularly preferred variant, the fastening arrangement is configured in such a way that the height of the acceleration element above the surface of the base can be set. As a result, the ball can be struck by the acceleration element centrally, below or above in relation to its horizontal center axis, as a result of which the trajectory of the ball in a first flight phrase transitions into an approximately horizontal flight (if struck approximately centrally), an upward trajectory (if struck below the horizontal center axis) or directly into a downward trajectory (if struck above the horizontal center axis). The further below the horizontal center axis the ball is struck, the greater is its angle of elevation and vice versa; the further above said horizontal center axis the ball is struck, the more pronounced is the negative angle of elevation or the drop angle.

In a second preferred embodiment, the fastening arrangement is configured in such a way that the inclination of the acceleration element with respect to the surface of the base can be set. In a further, third advantageous variant, the fastening arrangement is configured in such a way that the direction of the tip of the acceleration element can be set in a plane which is parallel to the surface of the base. It is particularly preferred if all three setting options are provided at the same time. This is the case, in particular, if the acceleration element is fastened to the drive arrangement by means of a height-adjustable carrier and is fastened to said carrier by way of a ball joint.

By way of the second and/or third design variant, it is possible, in addition to the positive or negative elevation angle, to also produce banana shots and/or spin of the ball during the flight phase. Therefore, as in real football, all trajectory variants of the ball can be preset by the player. Here, the acceleration element is preferably configured in the form of a football boot.

In one design variant, the fastening arrangement has a pin-shaped carrier which is held in the drive arrangement, is substantially perpendicular with respect to the surface of the base, and on which the acceleration element is arranged. By way of the drive arrangement, the carrier, arranged such that it can be displaced substantially linearly with respect to one or more ball holders, can be fixed spaced apart from the carrier by a distance so as to store acceleration energy. To this end, the drive arrangement has a spring means which is preferably formed by a rubber band but which can also be formed by a tension or compression spring made from metal. Furthermore, the drive arrangement preferably has fixing means which permit fixing of the tensioned drive means at different distances from the ball holder and/or with a spring means which is tensioned to a greater or lesser extent. In this way, the speed can be influenced, at which the acceleration element is traveling at the moment of impact with the ball. If no fixing means are provided, the drive arrangement can be held fixedly in the tensioned position by hand and can be released simply in order to trigger the shot. If fixing means are provided, a triggering means is preferably provided to this end which can cancel the fixing action by way of actuation of a lever. By way of the drive means, acceleration energy can be stored in the acceleration element and can be output to the ball if desired in a track-guided manner, that is to say in a controlled and targeted manner, preferably via a trigger, the drive arrangement being configured with at least one elastic element and at least one trigger. Here, as mentioned, the elastic element is advantageously configured as a replaceable rubber band element or as a rubber band.

In one embodiment, the spring means, in particular the rubber band element, can be arranged in a replaceable manner. By way of the variation of the spring rate of the spring means and/or the hardness and/or elasticity of the inserted rubber band element, the acceleration energy which is stored at a predefined distance of the acceleration element from the ball holder can be increased or reduced.

The acceleration element, or the football boot, is preferably fastened to the drive arrangement by way of a fastening arrangement comprising a joint with a locking means, in particular with a clamping element. The joint or the clamping element preferably has a spherical head which is arranged, in particular, on the abovementioned height-adjustable carrier of the fastening element. In this embodiment, a socket which fits the ball is arranged on the acceleration element. The locking means of the joint is preferably configured in such a way that the spherical head-shaped clamping element is configured in a surface-structured manner by means of a multiplicity of elevations in order to increase the friction with respect to the joint socket. This achieves a situation where the preset ball shooting position remains unchanged even during the output of the stored acceleration energy up to the moment of the ball impact position and even at the moment of the shot, that is to say during the impact of the acceleration element on the ball.

The ball holder can be formed by a depression in the surface of the base. There can be a plurality of ball holders of this type, in order that the impact point of the acceleration element on the ball can also be influenced by way of the selection of the ball holder. At any rate, the ball holder has to ensure that the ball lies ready, in a defined position and without rolling away, at the end of the acceleration section for the acceleration element, which acceleration section is defined by the drive arrangement. The ball holder/holders is/are preferably formed by elevations on the base, said elevations being formed, in particular, by way of a plurality of elevated faces which are spaced apart from one another uniformly. The height of said faces is selected to be so low that shooting of the ball is not impeded, but that said ball assumes a rest position between adjacent faces, in particular between four adjacent faces. The elevated faces are preferably formed by a velvet-like punctiform coating or flocking of the base surface. In the case of a grid-like arrangement of the elevated faces, the ball can be placed in a plurality of positions and a plurality of ball holders result.

In a further advantageous variant, the underside of the transparent, upper base cover, above which the acceleration element is arranged, is printed with an image which represents a pitch. As a result, firstly the impression of a football pitch can be reinforced, and secondly the ball can be placed both in a direct line to the acceleration element, and also to the side thereof, in such a way that it does not roll away before outputting of the acceleration energy. In addition, in a further variant, the game is provided with an opening in the base, which opening allows at least one ball, in other variants a plurality of balls at the same time, to be stored in a lockable manner. A cover is also provided for the game, which cover encloses the surface of the base in such a way that the game can be stored, for example, in a pocket or in a rucksack, without protruding parts being damaged in any way, for example the football boot which can be replaceable. The cover is advantageously formed from transparent plastic.

In a further, advantageous variant, a slot-shaped opening for at least one image carrier, for example a playing card, for example a playing card which depicts a football player, is also made in the base, in which opening spring elements lift and press the playing card/cards onto a viewing window. In addition, an access cutout is arranged in the slot-shaped opening and/or in the viewing window, by means of which access cutout at least one playing card can be removed from the slot-shaped opening, preferably the uppermost playing card of a playing card stack. As a result, the player is given the option to identify himself/herself while playing or while shooting with a player and/or a football club or a footballing country of his/her selection.

BRIEF DESCRIPTION OF THE DRAWINGS

Further preferred embodiments and advantages of the invention result from the dependent claims and from the description which now follows using the figures, in which:

WAYS OF IMPLEMENTING THE INVENTION

Figure 1:
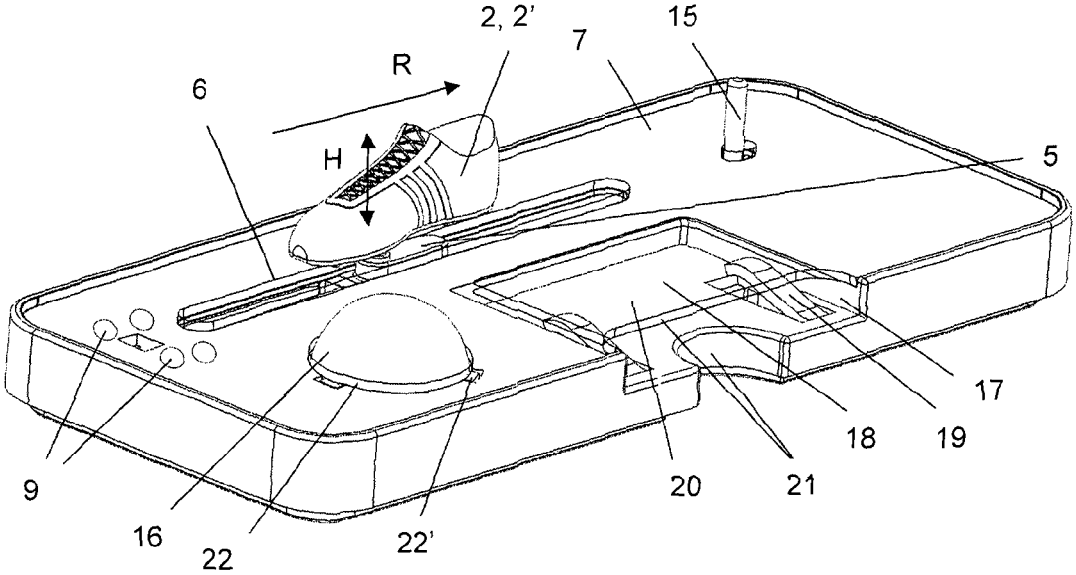
FIG. 1 shows a perspective illustration of a device for playing football.
Figure 2:
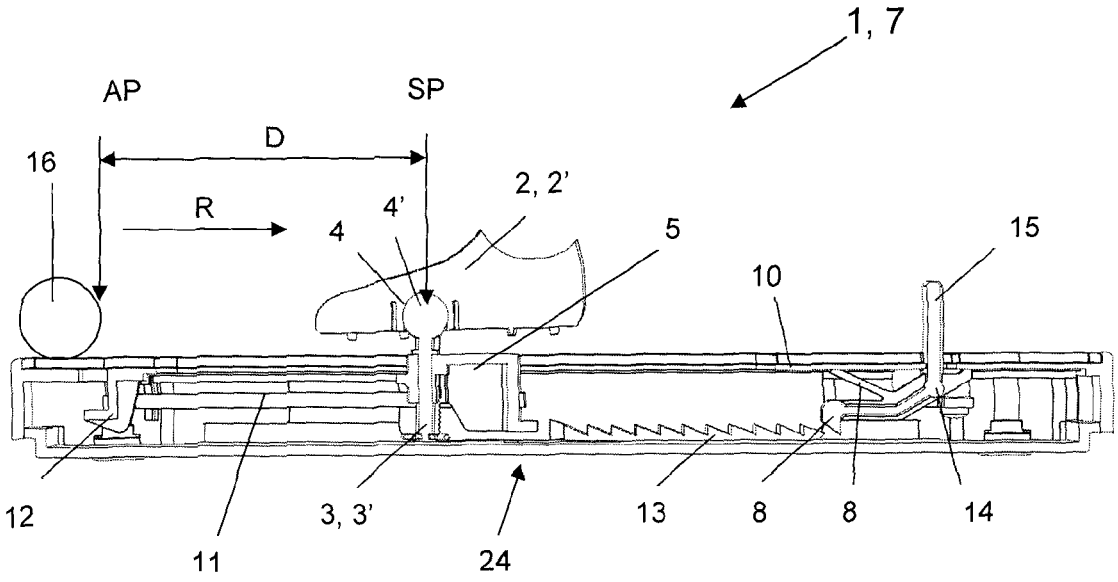
FIG. 2 shows a sectional view of the device for playing football from FIG. 1.

FIG. 1 shows one design variant of a device for playing football 1 in a perspective view. The play device 1 is provided with an acceleration element 2 which, as shown in FIG. 1, is advantageously configured as a football boot 2' which, as shown in FIG. 2, is fastened to a drive arrangement by way of a fastening arrangement. The fastening arrangement comprises a carrier 3, or a connecting element 3 which is substantially a pin 3' here, and a clamping element 4 which is formed as a surface-structured spherical head 4', on which the boot is seated such that it is held frictionally by way of a corresponding joint socket. The connecting element 3 (FIG. 2) is connected to a sliding guide 5 in the drive arrangement in such a way that it can be moved perpendicularly upward and downward and therefore is height-adjustable along a height H by a few millimeters to centimeters, depending on the design size of the device for playing football 1 and/or the football boot 2'. A latching means is preferably provided for the carrier 3, with the result that the height can be adjusted incrementally.

The slider 5 is, for example, part of a carriage which moves in the interior of the base 7 and protrudes out of the base 7 through a cutout 6 which can also form a guide for the slider, which cutout permits the slider 5, driven by the spring element (FIG. 2), to slide as far as in front of a ball holder which is formed, for example, by a plurality of elevated faces 9. That is to say, the slider 5 on the carriage in the base 7 can be moved backward and forward along a line which could also be of arcuate configuration in other variants, and is preferably also guided by at least one guide rail 10 which is arranged in the base 7 of the play device 1.

As shown in FIG. 2, a rubber band 11 runs around the slider 5, the slider 5 or the carriage, tensioned via the rubber band elements 12 by means of pulling back of the rubber band 11 in the direction R, latching with its prong-shaped holding elements 13 in a start position SP on a triggering element which is mounted on the base, and gaining acceleration energy after release by means of the triggering element 14. The acceleration energy can be stored by means of the stopper 8 of the triggering element and the prong-shaped holding element on the carriage or slider 5, in order then to release said acceleration energy again via the triggering mechanism 14 or by way of actuation of a lever-shaped triggering element 15. The game ball 16 can both be inserted into the cutout 6 or else on the abovementioned turf element 9 with the advantage that the ball is placed so as to not roll away before shooting.

In the particularly advantageous variant which is shown in FIG. 1, the device for playing football 1 is provided with a hole 17 for image carriers 18 which advantageously show portraits of known players. Here, spring elements 19 ensure that the image carriers 18 lie flat in a viewing window 20, preferably in a stacked manner. Thanks to an image carrier access cutout 21, in each case the uppermost image carrier 18 of a stack can be removed from the hole 17.

In addition, a base opening 22 with base rotary closure 22' is cut out in the device for playing football 1, into which base opening 22 at least one game ball 16 can be supplied. In other variants, a plurality of balls can also be supplied and can be closed in a latching manner by means of the base rotary closure 22'.

As mentioned, the toy variant which is shown in figure is suitable for a player to set the variably adjustable acceleration element 2 in such a way that it makes different ball trajectories possible when striking a ball 16 or dispatching the ball 16. The ball 16 can be played in a reproducible manner, for example, straight ahead, with a left-hand or right-hand spin or as a chip, for example over a player wall obstacle. In order to achieve or to assist this, a depression 23 (FIG. 2) is additionally formed in the acceleration element 2, into which depression 23 the spherical head 4' can be inserted, to be precise in such a way that, thanks to the surface structure of the spherical head 4' and the depression 23, the acceleration element 2 rotates in all directions and fixes selected positions so satisfactorily that said selected positions are not canceled during acceleration of the slider 5. The acceleration element 2 can assume positions, in which the acceleration element 2 points in an infinitely variable manner upward, downward, inward, outward or rearward. Since the connecting element 3 in the slider can be moved upward and downward, the acceleration element 2 can also be adjusted vertically with respect to the play ball 16. The connecting element 3 remains fixed at the selected height thanks to the clamping element 4 which is seated in the slider 5.

FIG. 2 also shows, in particular, a sectional view of the acceleration element 2, in which it can be seen how the spherical head 4' is seated in the depression 23 of the acceleration element 2 and, thanks thereto, the acceleration element 2 can rotate in all directions and remains fixed in selected positions. In addition, the abovementioned start position SP and an impact position AP of the acceleration element 2 are illustrated, as is the distance D which lies between them and varies, however, depending on the game embodiment, the elastic length or the tautening moment. The preferred embodiment with the ball joint permits setting of the inclination of the acceleration element, by the tip of the football boot therefore being able to be inclined so as to point to a greater or lesser extent toward the base surface or away from the latter. Furthermore, setting in a parallel plane to the base can take place, by no inclination of the tip therefore taking place, but rather a rotation about the carrier 3 or its vertical axis. If, instead of the spherical head, a cylindrical holder for the boot were provided, only this rotation would be possible, but not the inclination. The height adjustment preferably takes place via the height adjustment of the carrier 3, with the result that the carriage always runs in the same guide and does not change its vertical position with respect to the base.

Figure 3:
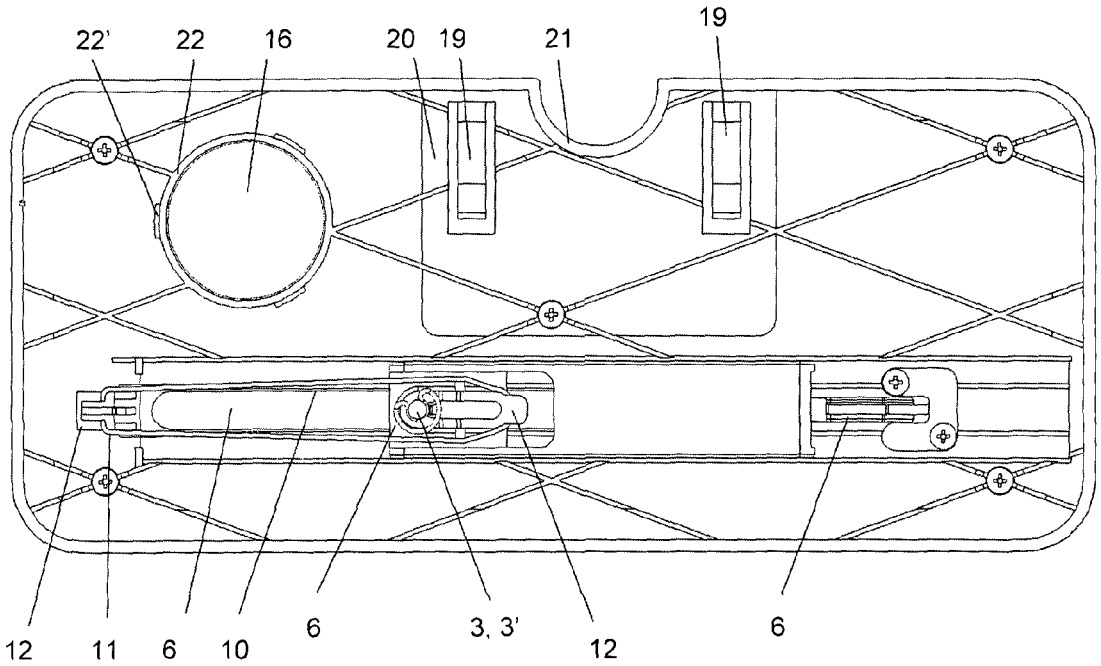
FIG. 3 shows a view of the play device from below without a bottom cover.

FIG. 3 shows a view of the play device 1 from below without a bottom plate 24 which protects the interior of the base 7 against dirt. It can be seen that the connecting element 3 in the clamping element 4 which is installed in the slider 5 can be adjusted upward and downward and remains fixed at a selected height.

In addition, as mentioned, FIG. 3 shows the rubber band 11 which is placed around the slider 5 and the rubber band elements 12, in order that a tension in the rubber band 11 and therefore acceleration energy can be obtained by way of pulling back the slider 5 in the direction R.

Figure 4:
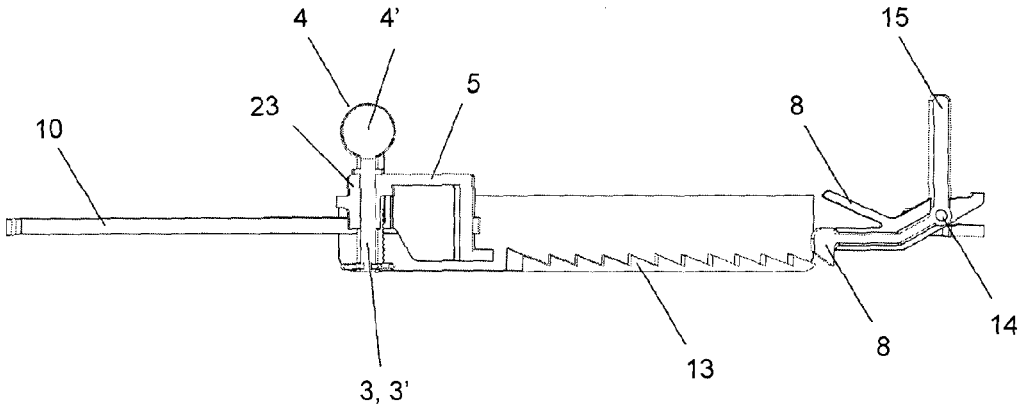
FIG. 4 shows a view of the drive arrangement and the fastening arrangement and a holding and triggering mechanism.

Finally, FIG. 4 shows a view of the slider 5 with holding mechanism 13 and triggering mechanism 14 about a pivot point which is guided in a guide rail 10 in the base 7. The substantially prong-shaped fixing elements 13 which are introduced in the slider 5 make it possible to store the acceleration energy by means of the stopper with spring element 8, and then to release said acceleration energy again by way of the triggering mechanism 13 and the triggering element 14.

The invention claimed is:

1. A device for playing football comprising a ball, a base, on which at least one ball holder is provided, an acceleration element and a drive arrangement for the acceleration element, which drive arrangement is configured to drive the acceleration element from a start position in the direction of the ball holder in such a way that the acceleration element strikes the ball in a driven manner, the acceleration element being fastened to the drive arrangement in a positionally adjustable manner by means of a fastening arrangement, in such a way that the impact position of the acceleration element on the ball which is situated on the ball holder can be set, whereby said positionally adjustable manner is selected from one or more of adjusting the height, adjusting the inclination or adjusting the tip of the acceleration element.

2. The device for playing football as claimed in claim 1, wherein the fastening arrangement is configured in such a way that the height of the acceleration element above the base can be set.

3. The device for playing football as claimed in claim 1, wherein the fastening arrangement is configured in such a way that the inclination of the acceleration element with respect to the surface of the base can be set.

4. The device for playing football as claimed in claim 1, wherein the fastening arrangement is configured in such a way that the direction of the tip of the acceleration element can be set in a plane which is parallel to the surface of the base.

5. The device for playing football as claimed in claim 1, wherein the fastening arrangement has a pin-shaped carrier which is held in the drive arrangement, is positioned substantially perpendicularly with respect to the surface of the base, and on which the acceleration element is arranged.

6. The device for playing football as claimed in claim 5, wherein the pin-shaped carrier is arranged such that it can be displaced substantially linearly with respect to the ball holder/holders, and in that the drive arrangement has a guide for the carrier, which is arranged on a slide and can be fixed by way of latching spaced apart from the ball holder by a distance so as to store acceleration energy.

7. The device for playing football as claimed in claim 1, wherein the fastening arrangement has a clamping element.

8. The device for playing football as claimed in claim 7, wherein the clamping element comprises a spherical head on the carrier and a socket on the acceleration element.

9. The device for playing football as claimed in claim 8, wherein the spherical head-shaped clamping element is configured on its surface in a structured manner by way of a multiplicity of elevations in order to increase the friction with the socket.

10. The device for playing football as claimed in claim 1, wherein the drive arrangement is configured with at least one elastic element and at least one trigger.

11. The device for playing football as claimed in claim 1, wherein the surface of the base and/or its underside is printed in a turf-like manner and/or is formed so as to protrude in a turf-like manner.

12. The device for playing football as claimed in claim 1, wherein at least one ball can be stored in an opening in the base.

13. The device for playing football as claimed in claim 1, wherein a slot-shaped opening for at least one image carrier is made in the base, and in that spring elements are provided which lift and press the image carrier onto a viewing window.

14. The device for playing football as claimed in claim 13, wherein an access cutout is arranged in the base and/or in the slot-shaped opening and/or in the viewing window, by means of which access cutout at least one image carrier can be removed from the slot-shaped opening.

15. The device for playing football as claimed in claim 14, wherein the access cutout is arranged in such a way that the uppermost image carrier of an image carrier stack can be accessed.

16. The device for playing football as claimed in one claim 1, wherein the at least one ball holder is formed by a plurality of elevated surfaces which are spaced apart from one another.

* * * * *